US005718177A

United States Patent [19]

Wronkiewicz et al.

[11] Patent Number: 5,718,177

[45] Date of Patent: Feb. 17, 1998

[54] RAILWAY TRUCK SIDEFRAME WITH INTERNAL RIBS IN BOTTOM MEMBER

[75] Inventors: Robert D. Wronkiewicz, Park Ridge; Brian A. Toussaint, Lisle, both of Ill.

[73] Assignee: AMSTED Industries Incorporated, Chicago, Ill.

[21] Appl. No.: 783,479

[22] Filed: Jan. 14, 1997

[51] Int. Cl.[6] ..... B61F 5/00

[52] U.S. Cl. ..... 105/206.1

[58] Field of Search ..... 105/206.1, 206.2, 105/182.1

[56] References Cited

U.S. PATENT DOCUMENTS

| | | | |
|---|---|---|---|
| 1,741,845 | 12/1929 | Johnson et al. | 105/206.1 |
| 2,235,799 | 3/1941 | Cottrell | 105/206.1 |
| 3,687,086 | 8/1972 | Barber | 105/206.1 |
| 3,872,795 | 3/1975 | Tack | 105/206.1 |
| 5,546,869 | 8/1996 | Nassar | 105/206.1 |

*Primary Examiner*—Mark T. Le

*Attorney, Agent, or Firm*—Edward J. Brosius; F. S. Gregorczyk; Stephen J. Manich

[57] ABSTRACT

The present invention provides a railway truck sideframe with a strengthened bottom member. The sideframe comprises an elongated top compression member, two diagonal tension members extending downwardly at acute angles from near the ends of the top compression member, and a bottom member joining the other ends of the diagonal tension members. The top surface of the bottom member is usually referred to as a spring seat as such top surface provides support for the spring group on which the railway truck bolster is supported. The bottom member and attached diagonal tension members are strengthened by the addition of internal support ribs within the generally hollow bottom member near the intersection with the diagonal tension member. An increased thickness in the intersection of the top surface of the bottom member and the diagonal tension member and/or column is also provided.

10 Claims, 4 Drawing Sheets

RAILWAY TRUCK SIDEFRAME WITH INTERNAL RIBS IN BOTTOM MEMBER

BACKGROUND OF THE INVENTION

The present invention relates to railway car trucks, and, more particularly, to railway car truck sideframes having an improved and strengthened bottom member.

Railway freight car trucks are usually comprised of a three piece arrangement wherein each truck comprises two sideframes laterally spaced from each other. Each sideframe includes a centrally located opening or bolster opening adapted to receive the ends of a bolster extending laterally between the sideframes. The ends of each sideframe are laterally aligned to receive an axle-wheel set in what is usually termed the pedestal jaw of the sideframe.

Typical three piece freight car trucks are shown in U.S. Pat. Nos. 2,235,799, 4,363,276 and 4,838,174.

A typical railway freight car truck sideframe is comprised of an elongated top compression member that extends in a longitudinal direction parallel to the railway track. The sideframe also comprises two diagonally extending tension members that extend at an acute angle from near the ends of the top compression member. A bottom member extends longitudinally and joins the lower ends of the diagonal tension members. The top portion of the bottom member is usually referred to as the spring seat of the sideframe and is adapted to receive the spring group upon which the ends of the bolster are supported. The bolster extends laterally between each sideframe. It should be understood that the sideframe is a unitary cast steel structure, as is the accompanying bolster. It should also be understood that the sideframe is an engineered structural member that is largely hollow to accomplish weight saving.

With the increased loading of today's freight cars, up to 286,000 lbs. of gross vehicle weight, the structural demands on the freight car truck, and especially the sideframes and bolster, are rather severe. The Association of American Railroads (AAR) has established certain standards for freight car trucks depending on their loading service. Such standards include dynamic test requirements as well as static test requirements. The static test requirements are related to the grade of steel from which the sideframes and bolsters are cast. It is desirable from an economy of production point of view to utilize the most economic grade of steel that meets the various loading requirements for the service to which the freight car truck is intended. It was noted with prior reduced weight sideframe designs that the maximum static vertical deflection exceeded the limits for Grade B steel. Accordingly, strengthening was needed, especially in the inter-face between the bottom member and the adjacent diagonal tension members of the sideframe. Various methods are possible to add such strength. Such methods could include the thickening of the top, bottom, and side walls of the bottom member and diagonal tension members themselves, thereby adding strength. Other ways of accomplishing such strengthening could be to increase the radius of curvature at such junctions thereby adding metal at the bottom member-diagonal tension member junction. It is desirable to provide increased strength with minimal or no increase in the weight of the freight car truck sideframes and bolsters.

Accordingly, it is an object of the present invention to provide an improved and strengthened railway truck sideframe.

SUMMARY OF THE INVENTION

The present invention provides a railway freight car sideframe with an improved and strengthened bottom member and diagonal members. A strengthened junction between the bottom member top surface and the column member is also provided. The entire sideframe shown in FIG. 2 of the drawings of the present case, is comprised of an elongated top compression member that extends longitudinally and parallel to the railway tracks. It is understood that the sideframe is a unitary cast steel structure. Two end sections each extend longitudinally from each end of the top compression member and form pedestal jaws adapted to receive the axle bearing end of the wheel sets. Two diagonal tension members extend downwardly from near the end of the top compression member at an acute angle to the top compression member. A bottom member extends longitudinally and joins the other ends of the diagonal tension members. Two column members are longitudinally spaced from each other and extend vertically between the bottom member and top compression member. The column members form the bolster opening or center opening of each sideframe. The top surface of the bottom member is referred to as the spring seat and is adapted to receive the spring group upon which the end of the bolster is supported.

With the increased weights carried by today's freight cars, concerns about cracking or yielding have arisen, especially in the corner of the inter-face between each column member and the spring seat. Yielding and stress fractures have occurred in this area that is also referred to as the turn of the spring seat or corner intersection between the column member and the spring seat. The sideframe is a complex engineered structure that is largely hollow. In cross-section, the sideframe usually in any section thereof can be said to be comprised of a top section, a bottom section, and two side sections joining the top and bottom sections. This is also true of the bottom member which itself can be said to be comprised of a top member, also referred to as the spring seat, a bottom member, and two side members joining the top and bottom members. Past designs of sideframes have included a center support rib that is longitudinally centrally located internally within the bottom member and extends longitudinally a short distance from the longitudinal center line of the bottom member.

The present invention has addressed the need for strengthening of the part of the spring seat area or the area of intersection between the spring seat and the column member. Such strengthening is accomplished by providing integrally cast, internal ribs that are laterally located inwardly from the outer walls of the bottom member, but yet spaced outwardly laterally from the center support rib. Each of the present support ribs extends from a position near the turn of the spring seat area or intersection between the column member and the bottom member to a point longitudinally less than the center of the bottom member. It could also be said that the support ribs of the present invention extend from the intersection of the diagonal tension member and the bottom member longitudinally to a point less than the center of the bottom member. Each support rib is a generally planar structure that extends from the top surface of the bottom wall of the bottom member to the top wall of the bottom member. Further strengthening can also be provided by increasing the thickness of the area of the junction corner between the top surface of the bottom member and the column or diagonal member.

For a standard 5 ft.–10 inch wheelbase railway track, the maximum vertical deflection for a test load of 140,000 lb. are as follows for Grades B, B+ and C steels:

| | Grade Steel | | |
|---|---|---|---|
| | B | B+ | C |
| Vertical deflection in inches | 0.042 | 0.051 | 0.058 |

The tension properties are as follows:

| Tension Test | | | |
|---|---|---|---|
| | Grade Steel | | |
| | B | B+ | C |
| Tensile Strength (PSI) | 70,000 | 80,000 | 90,000 |
| Yield Point (PSI) | 38,000 | 50,000 | 60,000 |
| Elongation in 2 in. (5%) | 24 | 24 | 22 |
| Reduction of Area (%) | 36 | 36 | 45 |

As can be seen, it is possible to, for example, allow a greater deflection if the track is composed of Grade B+, rather than B. However, Grade B+ steel is more costly to utilize. It is generally desirable to meet the loading deflection requirements with as inexpensive grade of steel as possible.

DESCRIPTION OF THE PREFERRED EMBODIMENT

Figure 1:
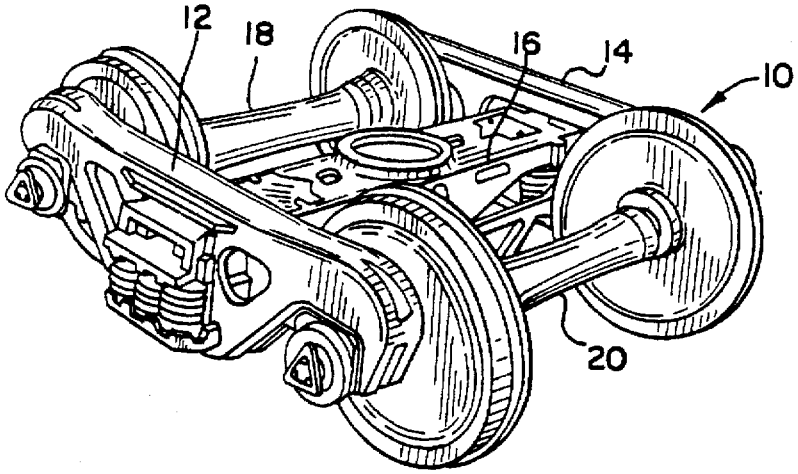
FIG. 1 is a perspective view of a railway truck comprised of two sideframes and a bolster.
Figure 2:
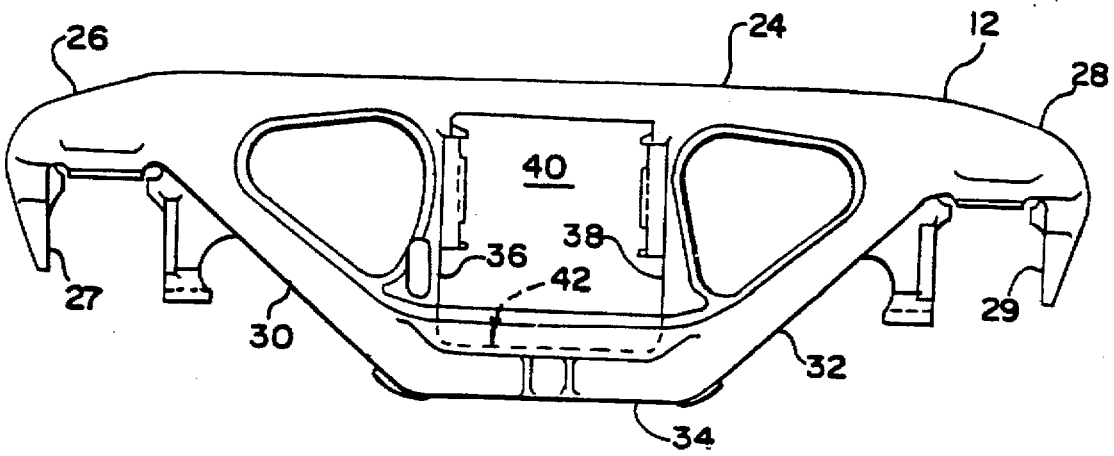
FIG. 2 is a side view of a sideframe in accordance with the present invention.

Referring now to FIGS. 1 and 2 of the drawings, a railway truck in accordance with the present invention is shown generally at 10. Railway truck 10 comprises sideframes 12 and 14 that are identical and are laterally spaced from each other. Axle wheelsets 18 and 20 are received in pedestal openings 27 and 29 formed at respective end section 26 and 28 of each sideframe. Bolster 16 extends laterally between sideframes 12 and 14 and is received in bolster openings intermediate the pedestal ends of both sideframes. Bolster opening 40 is shown in FIG. 2 for sideframe 12.

Referring now to FIG. 2 of the drawings, sideframe 12 is comprised of a longitudinal elongated top compression member 24 that runs longitudinally across the top part of sideframe 12 and ends in end sections 26 and 28. It is seen that pedestal opening 27 is formed at a lower portion of end section 26 and pedestal opening 29 is formed at a lower portion of section 28. Diagonal tension members 30 and 32 extend downwardly from top compression member 24 at a point near end sections 26 and 28. The angle at which diagonal tension members 30 and 32 extend is about 45 degrees. Bottom section 34 extends longitudinally and joins the lower end sections of diagonal tension members 30 and 32. Column members 36 and 38 are spaced longitudinally from each other and extend vertically from an upper portion of bottom section 34 near its junction with diagonal tension members 30 and 32 to a lower surface of top compression member 24. It is seen that the combination of the lower portion of top compression member 24, the upper portion of bottom section 34 and column members 36 and 48 form a generally rectangular bolster opening 40. The upper surface of bottom section 34 is also referred to as spring seat 42.

It should be understood that sideframes 12 and 14 are unitary cast steel structures. Such structures are cast in accordance with modem foundry practice that includes the use of cores to form the structural component of sideframe 12 in a generally hollow fashion such that each structural component such as top compression member 24 and bottom section 34 are generally hollow, each comprised of a bottom section and a top section and two side sections joined to the top and bottom sections.

Side frames may be cast in various carbon and alloy steels, such as Grades B, B+ and C. The properties of such steels were previously discussed.

Figure 4:
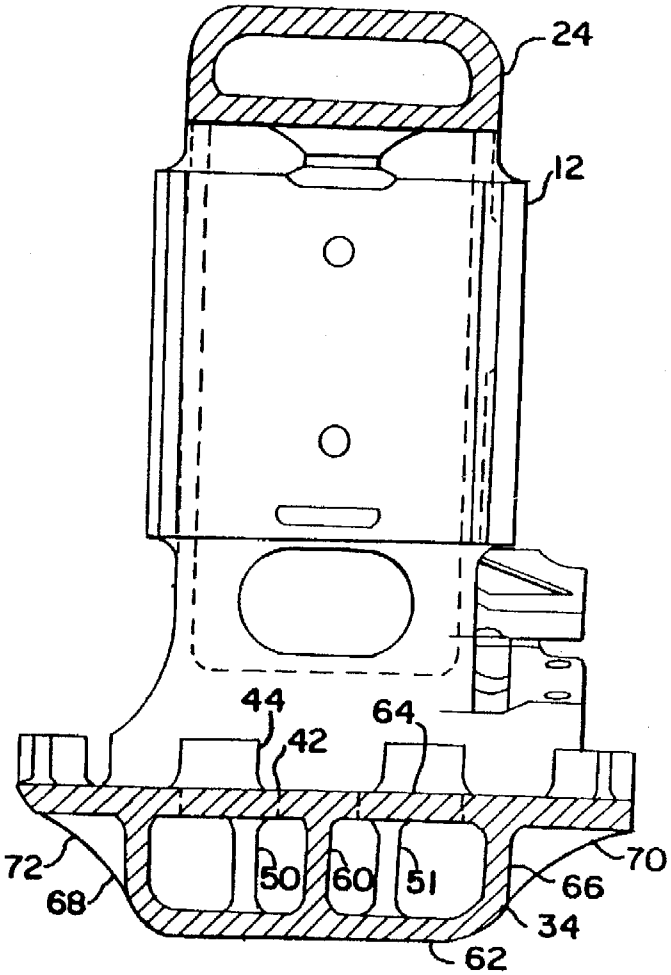
FIG. 4 is a cross sectional view of a sideframe in accordance with the present invention.
Figure 3:
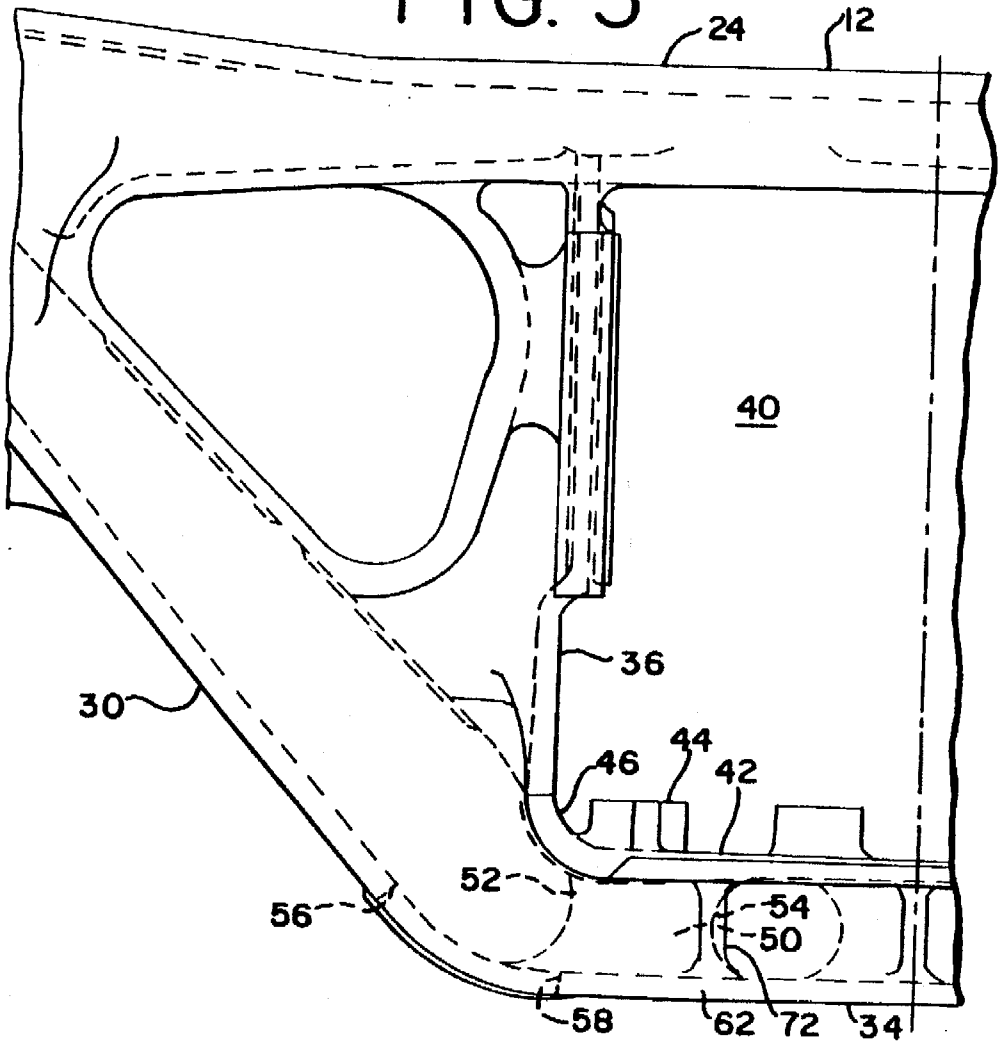
FIG. 3 is a partial side view of a sideframe in accordance with the present invention.

Referring now to FIGS. 3 and 4 of the drawings, sideframe 12 is shown in greater detail with appropriate cross sectioning. Bottom section 34 is seen to comprise bottom wall 62, top wall 64, the top surface of which acts as spring seat 42. Spring guides 44 extend upwardly from spring seat 42. Spring guides 44 act to form a pattern wherein the cylindrical springs are received and positioned to support the bolster end. Bottom section 34 is also comprised of sidewalls 66 and 68 that extend vertically upward from bottom wall 62 to top wall 64 and form the longitudinal outer edges of bottom section 34. Wall webs 70 and 72 are seen to extend from, respectively, wall 66 and 68 to intersect with an outer edge of top wall 64 thereby providing additional strength for spring seat 42.

Support ribs 50 and 51 are seen as extending longitudinally within bottom section 34. It is seen that each of support ribs 50 and 51 are spaced laterally from center support rib 60 and extend vertically from bottom wall 62 to top wall 64. Support ribs 50 and 51 are identical except for their lateral spacing. It should also be understood that sideframe 12 includes another set of support ribs located longitudinally from support ribs 50 and 52 and extending from bottom section 34 toward diagonal tension member 32. For the sake of brevity, only support ribs 50 and 51 are described in detail that extend from bottom section 34 toward diagonal tension member 30. It can also be said that support ribs 50 and 51 extend toward column 36.

It is seen that support rib 50 ends at an edge at 52 that is formed by the junction of the metal forming rib 50 with the core utilized during the casting of sideframe 12. The other longitudinal edge of support rib 50 is shown at 54 and is formed by contact of the metal forming rib 50 with a center core for forming the interior hollow portion of bottom section 34. A core hole is formed in bottom wall 62 by the portion of sideframe 12 extending from bottom wall 62 toward the lower surface of diagonal tension member 30. This core hole is formed at edges 56 and 58 and is laterally centrally located in bottom wall 62. It is seen that support rib 50 must be spaced laterally toward sidewall 68 and support rib 51 must be laterally spaced toward sidewall 66 to avoid the portion of this core hole nearest opening edge 58.

The general dimension of support rib 50, and the similar support ribs, is of a thickness of from 0.44 inch to 0.75 inch (1.12 cm to 1.90 cm), with a longitudinal extent of about 5 inches (13 cm) within bottom section 34.

It should also be noted that the thickness of metal at the junction of the column 36 in spring seat 42 at 46 is increased in the present invention from a prior art thickness of about 0.69 inches (1.75 cm) to about 0.94 inch (2.39 cm). This increased thickness adds strength to the junction area between the spring seat in column 36 and is seen to contribute to the improved strength and performance of sideframe 12.

Figure 5:
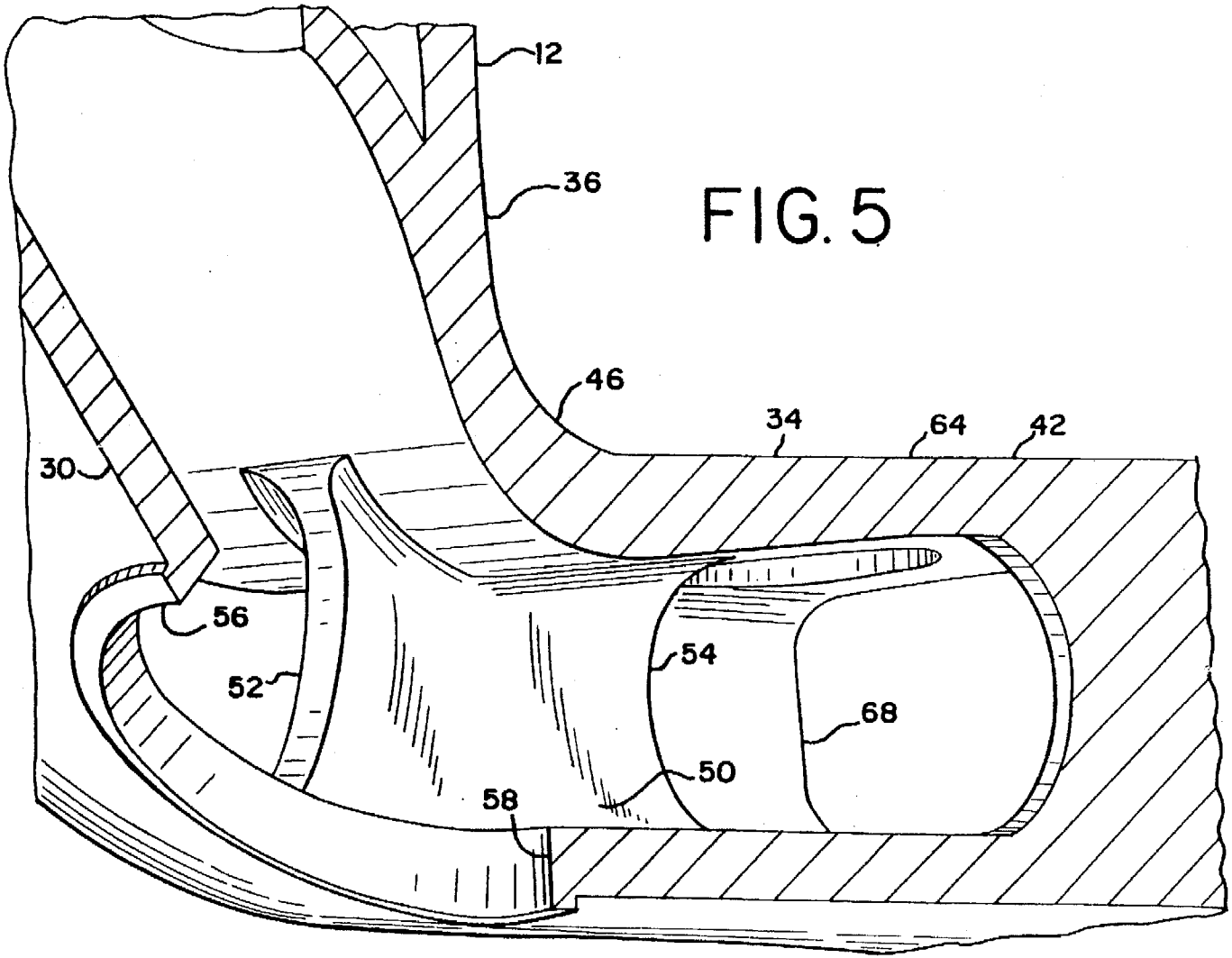
FIG. 5 is a partial cross sectional view of a portion of a sideframe in accordance with the present invention.

Referring now to FIG. 5 of the drawings, a detailed view of support rib 50 is shown. Support rib 50 is seen to extend from support edge 52 to support rib edge 54, which edges are formed by contact of the support rib metal when poured with particular cores that form the hollow sections within 34 and diagonal 30. The core hole previously described is seen as extending longitudinally from tension member opening edge 56 to a bottom section opening section 58. The lateral location of support rib 50 is seen as having to be laterally spaced from the core hole opening toward sidewall 68 to avoid the core hole opening. Increased thickness at the junction of 36 and top wall 64 is also readily shown in FIG. 5.

Figure 6:
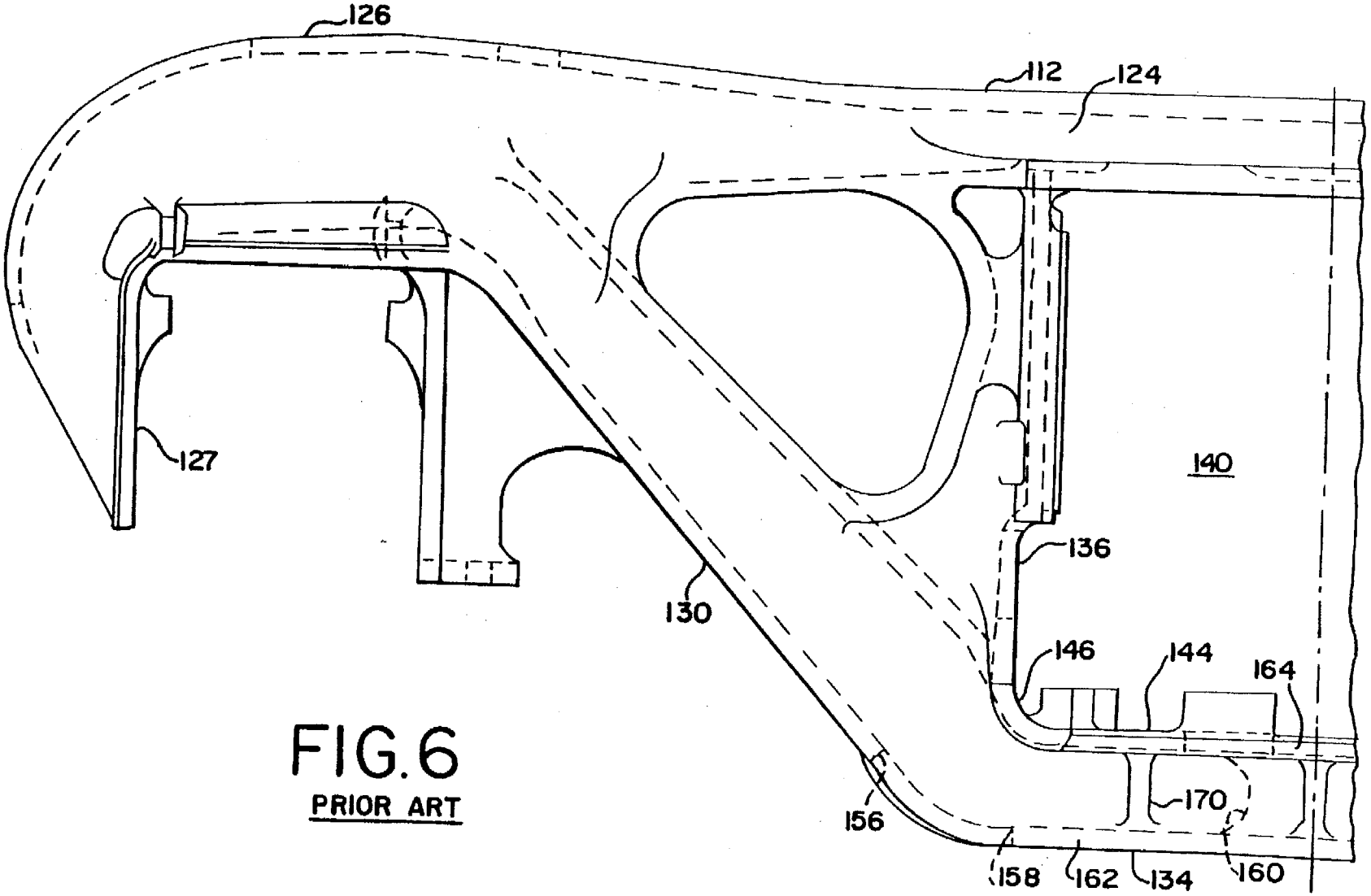
FIG. 6 PRIOR ART
FIG. 6 is a side view and partial cross section of a prior art sideframe.

Referring now to FIG. 6, prior art sideframe 112 is shown. Sideframe 112 includes top compression member 124 extending longitudinally to an end section 126. Of course, it is seen that FIG. 6 is a partial view with a similar end section not shown. End section 126 has a section extending downwardly to form pedestal jaw 127 adapted to receive an axle wheelset. Diagonal tension member 130 extends downwardly at an acute angle from near end section 126 and extends to form bottom section 134. Bottom section 134 extends longitudinally to join another diagonal tension member that is not shown which itself extends toward the other end of sideframe 112.

Bottom section 134 itself is comprised of bottom wall 162 and top wall 164, with sidewalls (not shown) that are spaced laterally from each other and joined to bottom wall 162 and to top wall 164. Center support rib 160 is seen to extend laterally centrally between the sidewalls and vertically between bottom wall 162 and top wall 164. Spring seat 144 is seen as being formed by the top surface of top wall 164. Column 136 extends upwardly vertically between the corner junction 146 of spring seat 144 and the bottom surface of top compression member 124. A generally rectangular bolster opening 140 is formed between column 136 and an identical column located longitudinally therefrom. A core hole is seen to be formed in bottom wall 162 extending toward the bottom surface of diagonal tension member 130 with longitudinal edges 156 and 158.

What is claimed is:

1. A sideframe for use in a railway car truck, said sideframe comprising an elongated top compression member extending longitudinally, two end sections each extending longitudinally from an end of said top compression member and each forming a pedestal jaw, two diagonal tension members each extending at an acute angle with said top compression member from near said end of said top compression member, a bottom member extending longitudinally and joining said diagonal tension members at a lower end of each diagonal tension member, two column members longitudinally spaced from each other and extending vertically between said bottom member and said top compression member, said bottom member and adjoining diagonal tension members being generally hollow, said bottom member comprising a top wall, a bottom wall and two side walls joining said top wall to said bottom wall, said bottom member also comprising four support ribs, each support rib extending vertically between said top wall and said bottom wall, and each support rib extending longitudinally from near the intersection of said bottom member and said adjoining diagonal tension member to a point longitudinally within said bottom member, said support ribs being provided in laterally spaced pairs, each support rib located laterally inward from a side wall of said bottom member, wherein said bottom member includes two center core holes in said bottom wall, each of said center core holes located laterally between said side walls of said bottom member and longitudinally near the junction of said diagonal tension members and said bottom member, each of said support ribs extending vertically between said top wall and said bottom wall of said bottom member from a position along said bottom wall laterally between said center core hole and one of said side walls of said bottom member.

2. The sideframe of claim 1, wherein each of said support ribs is an integrally cast steel portion of said sideframe, each of said support ribs having a lateral thickness of about 0.44 inch to 0.75 inch (1.12 cm to 1.90 cm).

3. The sideframe of claim 1, wherein, during the casting of said sideframe, a bottom center core is provided that limits the longitudinal extent of said support rib to a point less than halfway longitudinally across said bottom member.

4. The sideframe of claim 1, wherein each of said support ribs extends longitudinally beyond the intersection of said bottom member and said adjoining diagonal tension member to a point within said diagonal tension member.

5. A sideframe for use in a railway car truck, said sideframe comprising an elongated top compression member, two diagonal tension members each extending generally downwardly from near an end of said top compression member, a bottom member joining said diagonal tension members at a lower end of each diagonal tension member, two column members extending vertically between said bottom member and said top compression member, said bottom member and said diagonal tension members being generally hollow, said bottom member comprising a top wall, a bottom wall and two side walls joining said top wall to said bottom wall, four support ribs within said bottom member, said support ribs extending vertically between said top wall and said bottom wall, each support rib extending longitudinally from near the intersection of said bottom member and said adjoining diagonal tension member to a point longitudinally within said bottom member, wherein each bottom member includes two center core holes in said bottom wall, each of said center core holes located laterally between said side walls of said bottom member and longitudinally near the junction of said diagonal tension members and said bottom member, and each of said support ribs extending vertically between said top wall and said bottom wall of said bottom member from a junction along said bottom wall laterally spaced from said center core hole and one of said side walls of said bottom member.

6. The sideframe of claim 5, wherein each of said support ribs is an integrally cast steel portion of said sideframe, each of said support ribs having a lateral thickness of from 0.44 inch to 0.75 inch (1.12 cm to 1.90 cm).

7. The sideframe of claim 5, wherein, during the casting of said sideframe, a bottom center core is provided that limits the longitudinal extent of said support rib to a point less than halfway longitudinally across said bottom member.

8. The sideframe of claim 5, wherein each of said support ribs extends longitudinally beyond the intersection of said bottom member and said adjoining diagonal tension member to a point within said diagonal tension member.

9. The sideframe of claim 5, wherein said sideframe is comprised of Grade B+steel.

10. The sideframe of claim 5, wherein said top wall of said bottom member intersects at a corner section with each of said column members, and wherein said corner section is of thickness of about 0.94 inch (2.39 cm).

* * * * *